US007624472B2

(12) United States Patent
Ambrose

(10) Patent No.: US 7,624,472 B2
(45) Date of Patent: Dec. 1, 2009

(54) PIPE COUPLER FOR IN-WALL CENTRAL VACUUMING SYSTEM

(76) Inventor: Roger A. Ambrose, 2244 Catalonia Way South, St. Petersburg, FL (US) 33712

( * ) Notice: Subject to any disclaimer, the term of this patent is extended or adjusted under 35 U.S.C. 154(b) by 871 days.

(21) Appl. No.: 10/866,975

(22) Filed: Jun. 14, 2004

(65) Prior Publication Data

US 2004/0250371 A1 Dec. 16, 2004

Related U.S. Application Data

(60) Provisional application No. 60/478,274, filed on Jun. 13, 2003.

(51) Int. Cl.
*A47L 5/38* (2006.01)

(52) U.S. Cl. ..... 15/314; 15/353

(58) Field of Classification Search ..... 15/314, 15/339, 353, 315, 319; 55/DIG. 8; 285/196, 285/216; 287/7, 302, 303, 338
See application file for complete search history.

(56) References Cited

U.S. PATENT DOCUMENTS

| | | | | | |
|---|---|---|---|---|---|
| 2,596,210 | A * | 5/1952 | Cogshall | 200/61.6 |
| 3,048,875 | A * | 8/1962 | Bottinelli et. al. | 15/301 |
| 3,258,553 | A * | 6/1966 | Breslin | 200/51 R |
| 3,422,482 | A * | 1/1969 | Hamrick | 15/314 |
| 3,676,986 | A * | 7/1972 | Reiling | 55/472 |
| 4,336,427 | A * | 6/1982 | Lindsay | 200/61.6 |
| 4,645,150 | A * | 2/1987 | Taylor | 248/56 |
| 5,349,146 | A * | 9/1994 | Radabaugh | 200/61.6 |
| 5,578,795 | A * | 11/1996 | Ward | 174/53 |
| 5,924,164 | A * | 7/1999 | Lindsay, Jr. | 15/314 |
| 5,926,908 | A * | 7/1999 | Lindsay, Jr. | 15/319 |
| 6,459,056 | B1 * | 10/2002 | Graham | 200/61.6 |
| 7,010,829 | B2 * | 3/2006 | Harman et al. | 15/315 |
| 2004/0088815 | A1 * | 5/2004 | Tracy et al. | 15/320 |
| 2004/0177468 | A1 * | 9/2004 | Smith et al. | 15/314 |
| 2004/0250371 | A1 * | 12/2004 | Ambrose | 15/314 |

* cited by examiner

*Primary Examiner*—Lee D Wilson
(74) *Attorney, Agent, or Firm*—Larson & Larson, P.A.; Frank Liebenow

(57) ABSTRACT

An in-wall central vacuuming system has a central receptacle and a vacuum pump for drawing dirt and dust into a network of piping and into the receptacle. The system includes a series of ports strategically located around an interior environment of a residential or commercial building. The series of ports permit a flexible tubular hose to be connected thereto. Each port includes an interior wall mounting plate positioned behind the port and has axially aligned circular openings for receiving the flexible tubular hose. An elbow positioned within the wall attaches to a rearwardly extending tubular portion of the mounting frame and attaches to an odd sized first pipe section. A coupler member attaches the odd sized first pipe section to a universally available second pipe section which is used to create a network of piping for the system.

4 Claims, 5 Drawing Sheets

PIPE COUPLER FOR IN-WALL CENTRAL VACUUMING SYSTEM

PRIOR APPLICATIONS

This is a non-provisional application, whish bases priority on provisional application Ser. No. 60/478,274, filed Jun. 13, 2003, now abandoned.

BACKGROUND OF THE INVENTION

1. Field of the Invention

This invention relates to a central vacuuming system located within the walls of residential or commercial buildings. In particular, it relates to a central vacuuming system that employs a coupler member within the wall of the building which permits the use of universally available piping to be used in conjunction with specialized piping employed with central vacuuming systems.

2. Background of the Prior Art

Central vacuuming systems for use in residential and commercial buildings are known. The systems typically employ a network of pipes positioned within the walls of the building such that they are not visible to the eye. A series of ports, acting as terminals or access points, are positioned around the building for permitting a user to attach an external tubular member, typically flexible in natural, having an opening at a distal end. The open distal end is used to draw dirt and dust inwardly to the vacuuming system for removal from the environment. Brushes of varying configurations can be attached to the open distal end to assist in the dirt and dust removal process. The number of ports is dependent on the size of the area to be covered such that the entire inside area of a building or residence can be cleaned with a central vacuuming system.

The network of pipes terminate at a central location and deposit all of the dirt and dust removed from the environment into a container at the central location which can be emptied when full. Accordingly, the container is typically positioned at a central location which can be easily accessed by the user. A motorized pump is used in combination with the pipe network and acts to create a vacuum draw through the pipes to the container when an external tubular member is attached at one of the series of ports.

The network of pipes is fished within the walls of the building either before the internal walls are installed or afterward as a "retrofit" procedure. The pipes used in these systems are unique to central vacuuming systems and are therefore not readably available. The unique vacuum piping used has an inner diameter of 1 and 13/16 inches and is typically made from PVC. The elbows needed to attach this unique pipe are configured to accept the odd sized vacuum piping thereby permitting the network of piping to communicate with each of the series of ports. Accordingly, readably available piping, elbows and couplers which are easily located at any given home improvement store or typical hardware store can be not used with the known prior art in-wall central vacuuming systems.

An improved system is needed, which employs readably available piping so that the installation of central vacuuming systems can be done efficiently and inexpensively. An improved coupler member should be used to facilitate the coupling of the readably available piping with that which is unique to central vacuuming systems.

SUMMARY OF THE INVENTION

I have invented an improved central vacuuming system which employs a novel coupler member. My system utilizes a series of ports strategically located around an inside area of a building. Face plates are employed at each port such that when the ports are not being used, the port opening can be covered by a hinged plate member on either a top or bottom portion thereof. The face plate is in turn mounted to an interior wall mounting frame. An elbow (typically of 90 degrees) mounts to a backside of the mounting frame. A short section of a first pipe then attaches to an open top end of the elbow. The first pipe is unique to central vacuuming systems and is not readably available. Accordingly, a novel coupling member is attached to an open top end of the first pipe. The coupling member is constructed at a bottom end to attach to the odd sized first pipe. A top end of the coupling member is constructed to accept universally available PVC piping (like that use for plumbing) such as, for example, schedule 40 PVC piping. The universally available piping is then fished throughout the building thereby establishing the network of piping for the central vacuuming system.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
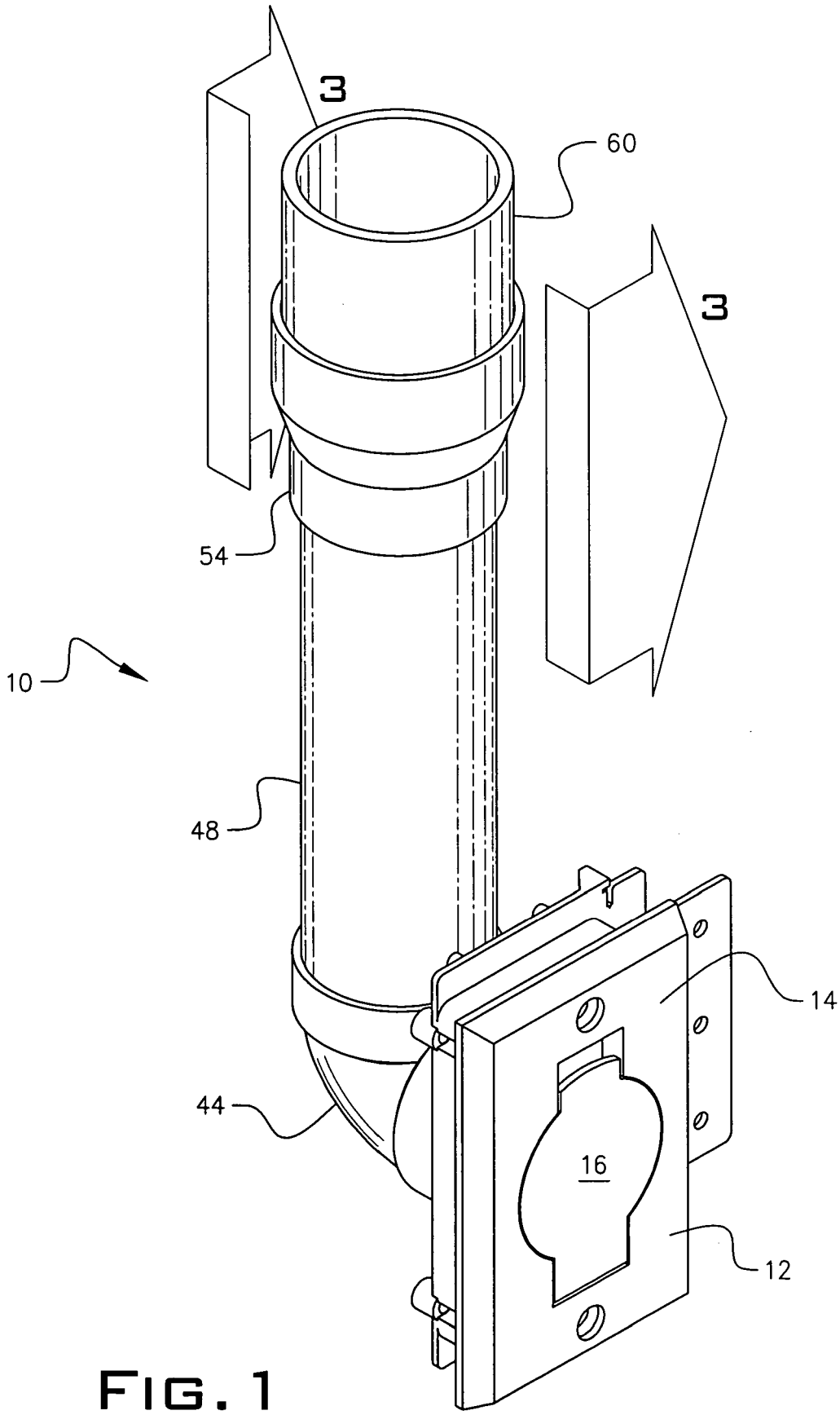
FIG. 1 illustrates an improved coupler of the present invention employed with a central vacuuming system depicting how the improved coupler attaches readably available piping to the unique pipe employed with central vacuum systems.

Throughout the following detailed description, the same reference numerals refer to the same elements in all figures.

Referring to FIG. 1, a single section of a central vacuuming system 10 is shown. Central vacuuming system 10 includes a series of ports strategically located within the inner area of a residential or commercial building. FIG. 1 depicts one of those ports 12.

Figure 2:
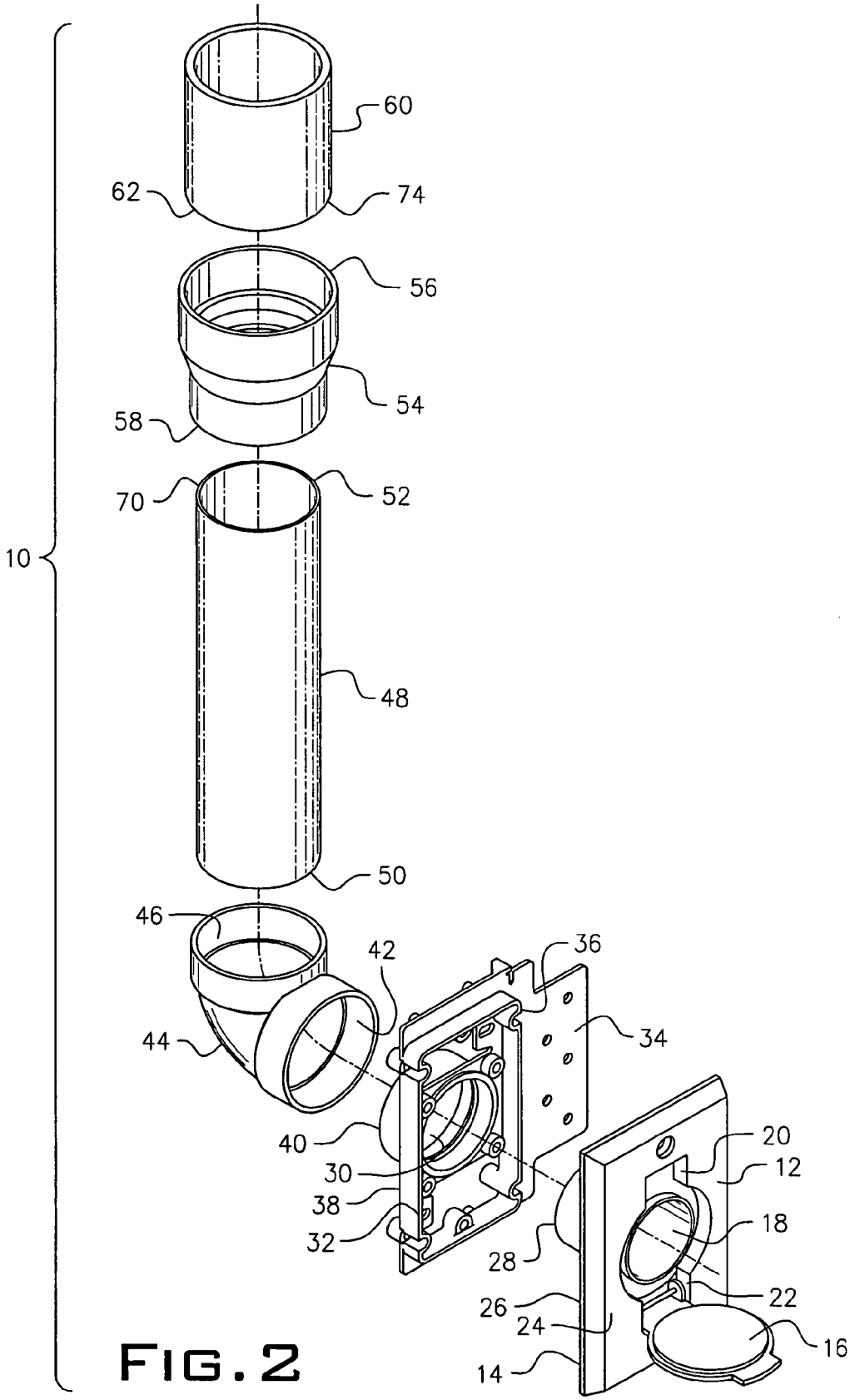
FIG. 2 is an exploded view of the embodiment of FIG. 1.

As shown in FIG. 2, port 12 includes a face plate 14 and a cover member 16 for closing off an opening 18 when not in use. In the preferred embodiment, cover member 16 is hinged at either a top or bottom end, 20 and 22 respectively. In the preferred embodiment, cover member 16 is hinged at bottom end 22. As further shown in FIG. 2, opening 18 is circular in shape. Port 12 includes a front and back side, 24 and 26 respectively. Face plate 14 is positioned on port front side 24. Port back side 26 has a rearwardly extending tubular member 28 which mates by axial alignment with an aperture 30 of an interior wall mounting frame 32. Mounting frame 32 is attached to an interior wall frame member (not shown) by screwing a side plate member 34 to the wall frame member. Mounting frame 32 also includes a front and back side 36 and 38 respectively. Mounting frame front side 32 mates with port back side 26. Mounting frame back side 38 includes a backwardly extending tubular member 40 which mates with an open bottom end 42 of an elbow 44. Elbow 44 further includes an open top end 46 which mates with a shorten section of a first pipe 48 at an open bottom end 50. First pipe 48 has a length of about 8", an inner diameter 1 and 13/16" and is cylindrical in shape. First pipe 48 is an odd sized pipe which is not readably available. First pipe 48 also includes an open top end 52.

With continuing reference to FIG. 2, a coupler member 54, having a top and bottom end, 56 and 58 respectively, is disposed upon first pipe top end 52 at coupler member bottom end 58. Coupler member top end 56 attaches to a second pipe 60 at a bottom end 62 thereof. Second pipe 60 is made from a readably available piping, such as, for example, schedule 40 PVC plumbing pipe having an inner diameter of 2".

Figure 3:
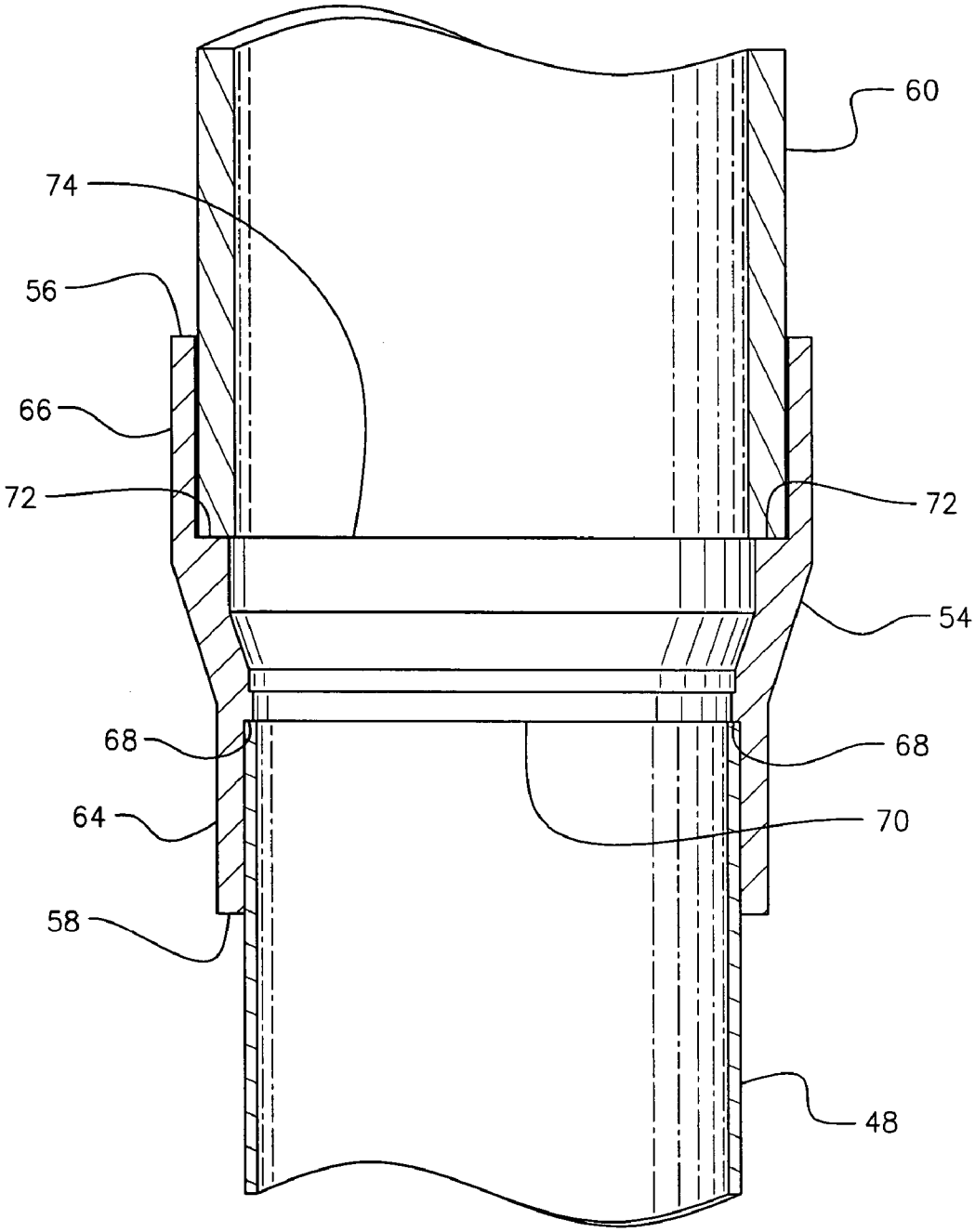
FIG. 3 is cross sectional view of FIG. 1 along lines 3-3.

With reference to FIG. 3, a cross sectional view along lines 3-3 of FIG. 1 of coupler member 54 is shown. Coupler member 54 has a first inner diameter of a lower section 64 of bottom end 58 and a second inner diameter of an upper section 66 of top end 56. Coupler member lower section 64 also includes a lower shoulder portion 68 which abuts against an upper periphery 70 of first pipe 48 thereby acting as a stop for first pipe 48. Likewise, coupler member upper section 66 includes an upper shoulder portion 72 which abuts against a lower periphery 74 of second pipe 60 thereby acting as a stop for second pipe 60.

Figure 4:
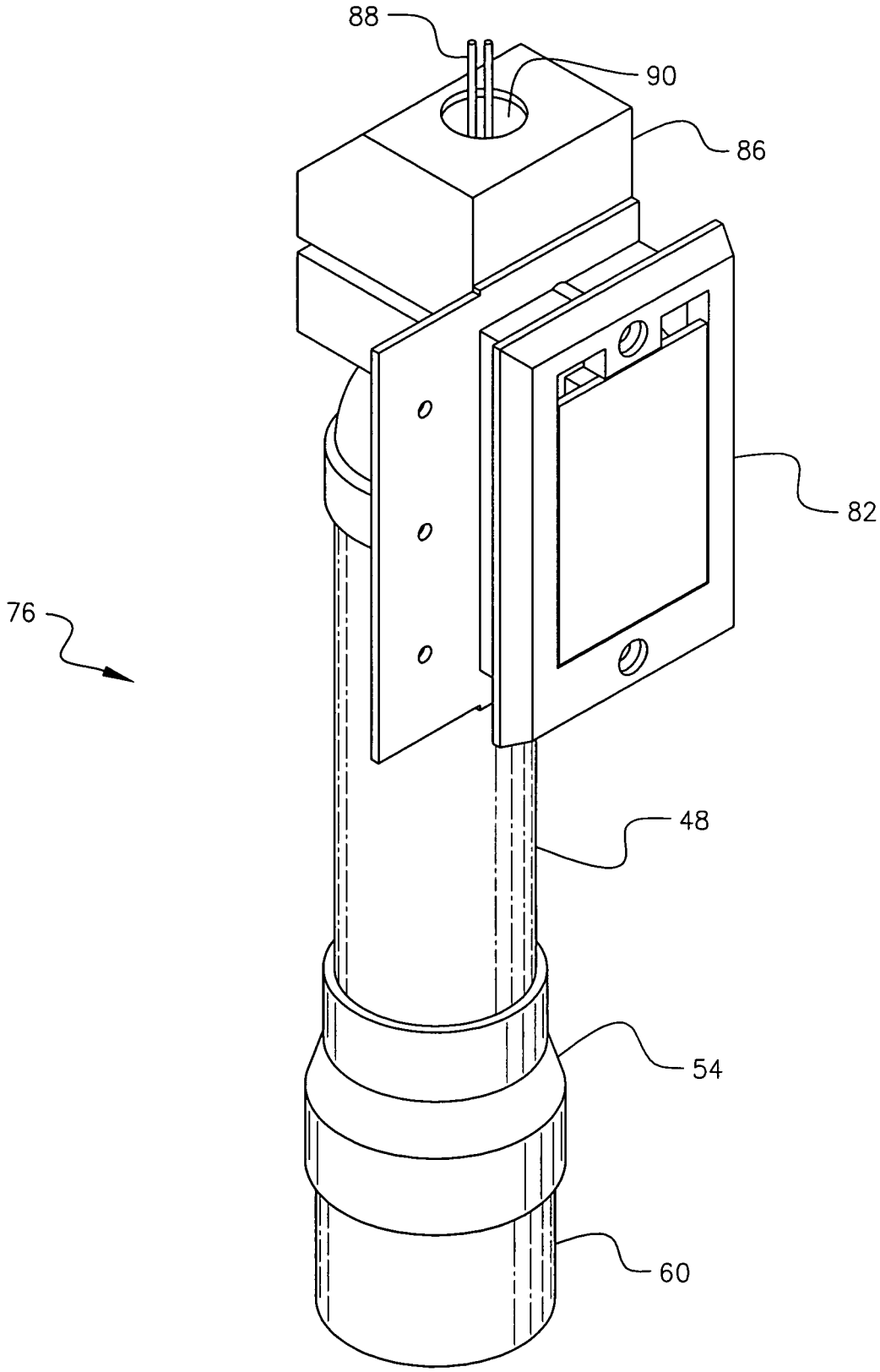
FIG. 4 illustrates an improved coupler employed with an alternate embodiment of a central vacuuming system of the present invention, again depicting how the coupler attaches readably available piping to the unique pipe employed with central vacuum systems.
Figure 5:
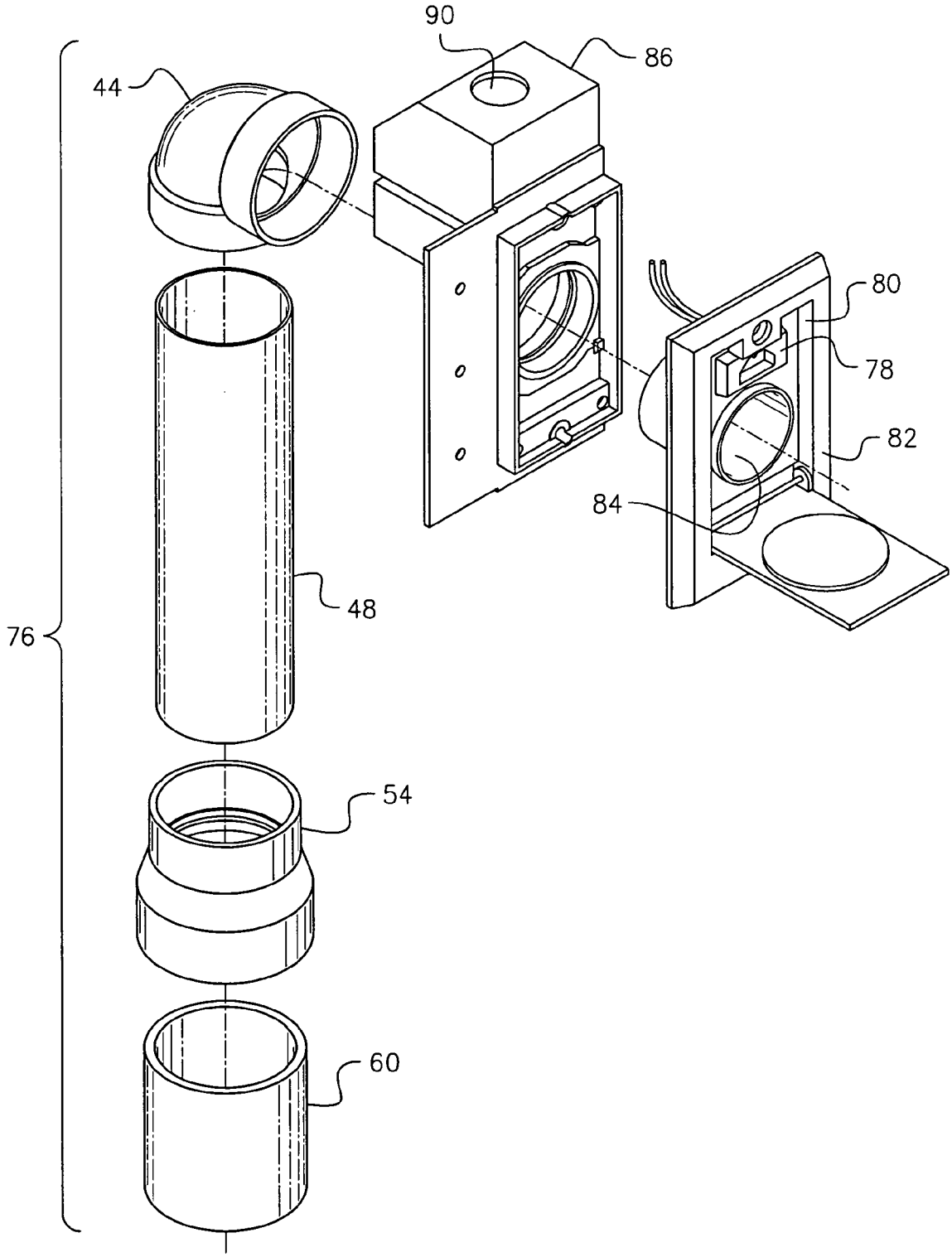
FIG. 5 is an exploded view of FIG. 4.

As shown in FIGS. 4 and 5, an alternate embodiment of central vacuuming system 76 is shown. Alternate central vacuuming system 76 employs many of the same elements of that of preferred system 10. However, system 76 further includes an electrical inlet valve 78 located at a top end 80 of a port 82. Electrical inlet valve 78 is hard wired to a 120 v AC circuit and is used to power attachments (not shown) which may be used with the flexible tubular hose which is used to pick up dirt and dust from the environment to be cleaned and is attached to the circular opening 84. Further, interior wall mounting frame 32 of alternate system 76 includes a wiring box 86 from which wires 88 thread through an opening 90 which are electrically coupled to electrical inlet valve 78.

Although not shown, a set (a pair) of contact beads are located along an inner circumference 86 of openings 18 or 84 which, when engaged, initiate the vacuum draw within the network of piping associated with any given port 12 or 82.

Equivalent elements can be substituted for the ones set forth above such that they perform in the same manner in the same way for achieving the same result.

What is claimed is:

1. An in-wall central vacuuming system having a central receptacle and a vacuum pump for drawing dirt and dust into a network of piping and into the receptacle, the system comprising:

a) at least one port having a first opening for receiving a flexible tubular hose, an electrical inlet valve disposed along a top portion of the at least one port;

b) an interior wall mounting plate positioned behind the at least one port and having a second opening such that the first and second opening are axially aligned when the at least one port is attached to the interior wall mounting plate, and a wiring box having an opening for guiding electrical wires from the electrical inlet valve to the AC power source, the wiring box attached atop of said interior wall;

c) a rearwardly extending tubular portion of the interior wall mounting plate positioned along a back side thereof;

d) an elbow having a first and second opening, the first opening attached to the rearwardly extending tubular portion;

e) a first pipe section having a top and a bottom end, the first pipe section bottom end attached to the elbow second opening;

f) a coupler member having a top and bottom section with corresponding top and bottom ends of different inner diameter, the coupler member bottom end having a narrower inner diameter than the top end, the first pipe section top end press fit into the coupler bottom end;

g) a second pipe section having a bottom end press fit into the coupler member top end; and h) the second pipe section forming a network of piping terminating at the central vacuuming system receptacle.

2. The in-wall central vacuuming system of claim 1, wherein the coupler includes a lower shoulder portion of the lower section and an upper shoulder portion of the upper section.

3. The in-wall central vacuuming system of claim 2, wherein the coupler lower section lower shoulder portion provides a stop for the first pipe section along an upper periphery of the first pipe.

4. The in-wall central vacuuming system of claim 2, wherein the coupler upper section upper shoulder portion provides a stop for the second pipe section along a lower periphery of the second pipe.

* * * * *